US005297942A

United States Patent [19]

Fleishman et al.

[11] Patent Number: 5,297,942

[45] Date of Patent: Mar. 29, 1994

[54] POROUS ROTOR

[76] Inventors: Roc V. Fleishman, 320 Market St., Venice, Calif. 90291; John M. Popovich, 650 Pheasant Dr., Los Angeles, Calif. 90065; Carsten H. Idland, 3526 Centinela Ave., #8, Los Angeles, Calif. 90066

[21] Appl. No.: 928,333

[22] Filed: Aug. 12, 1992

[51] Int. Cl.[5] ..... F04B 39/00

[52] U.S. Cl. ..... 417/354; 415/119; 34/97; 417/423.2

[58] Field of Search ..... 34/96, 97; 417/321, 417/352, 353, 354, DIG. 1, 423.2; 415/90, 119; 416/179, 184, 185, 231 R

[56] References Cited

U.S. PATENT DOCUMENTS

| | | | |
|---|---|---|---|
| 3,123,286 | 3/1964 | Abbott | 230/134 |
| 3,128,940 | 4/1964 | McDonald | 230/134 |
| 3,190,544 | 6/1965 | McDonald | 230/134 |
| 4,795,314 | 1/1989 | Prybella et al. | 417/43 |
| 4,795,319 | 1/1989 | Popovich et al. | 417/354 |

*Primary Examiner*—Henry A. Bennet
*Assistant Examiner*—Denise L. Gromada
*Attorney, Agent, or Firm*—William W. Haefliger

[57] ABSTRACT

A quiet fluid passing apparatus comprising a fluid passing rotor comprising open porous structure extending along an annular path, the rotor forming passage means to pass fluid through the rotor open porous structure as the rotor rotates; said path having an inner circumference with diameter ID and an outer circumference with diameter OD, and wherein $$\frac{ID}{OD} < .65$$

The quiet, fluid-passing apparatus may include open porous structure in combination with structures, such as blades and honeycomb material, to form rotors capable of moving fluid in axial or radial directions.

29 Claims, 12 Drawing Sheets

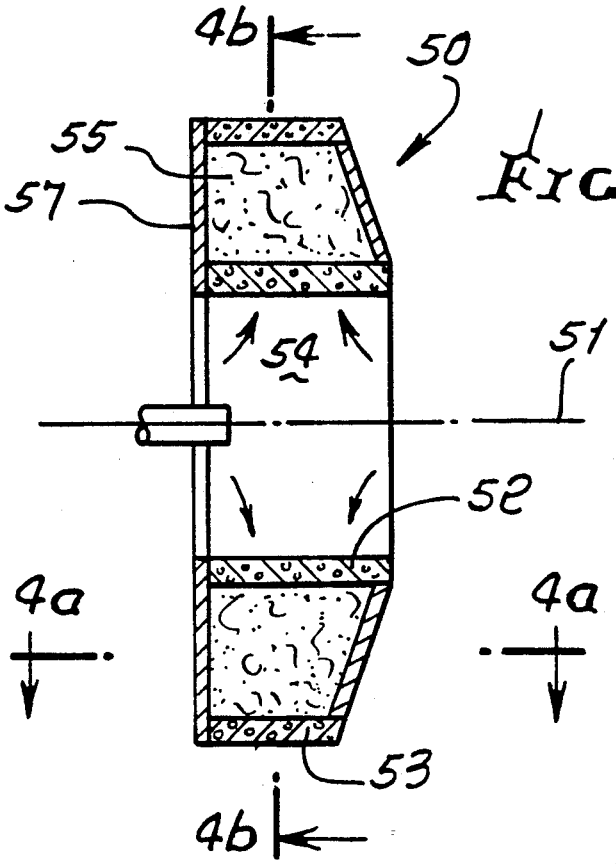
FIG. 4.
FIG. 4a.
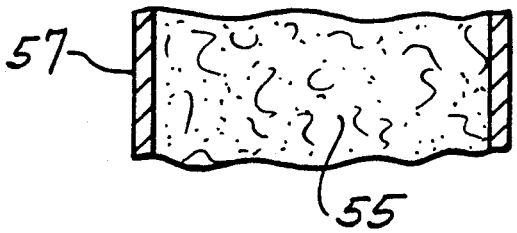
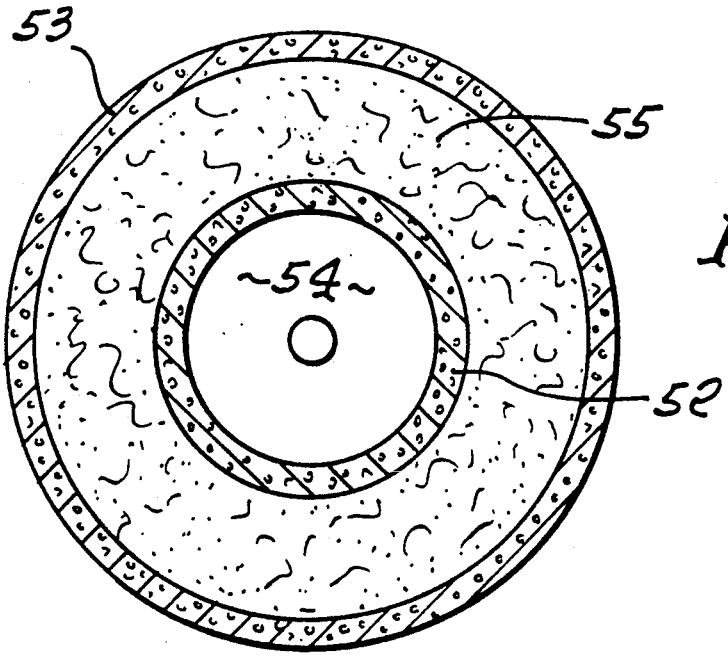
FIG. 4b.

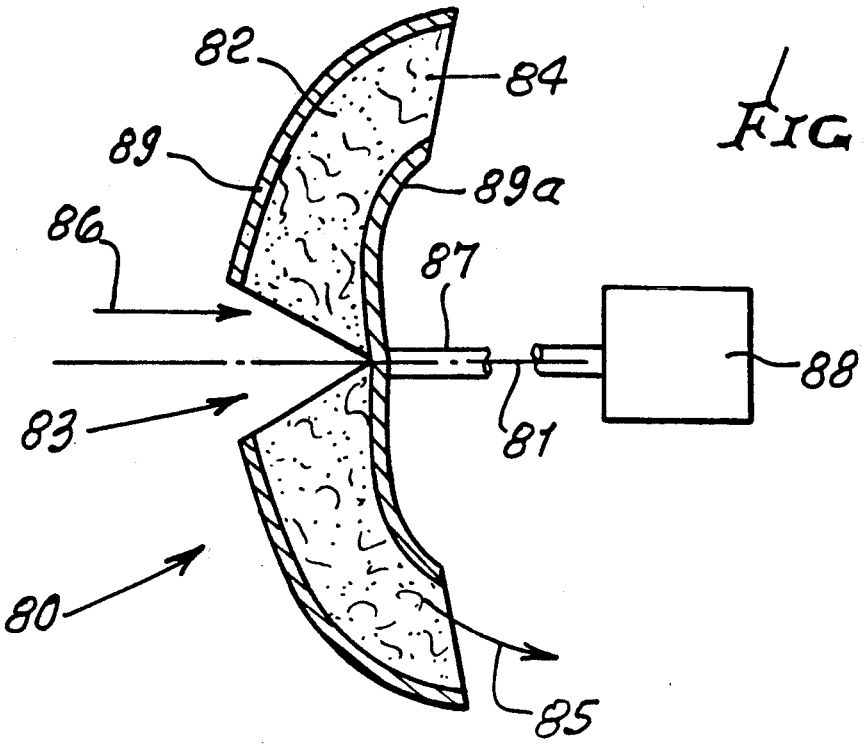
FIG. 6.
FIG. 7.
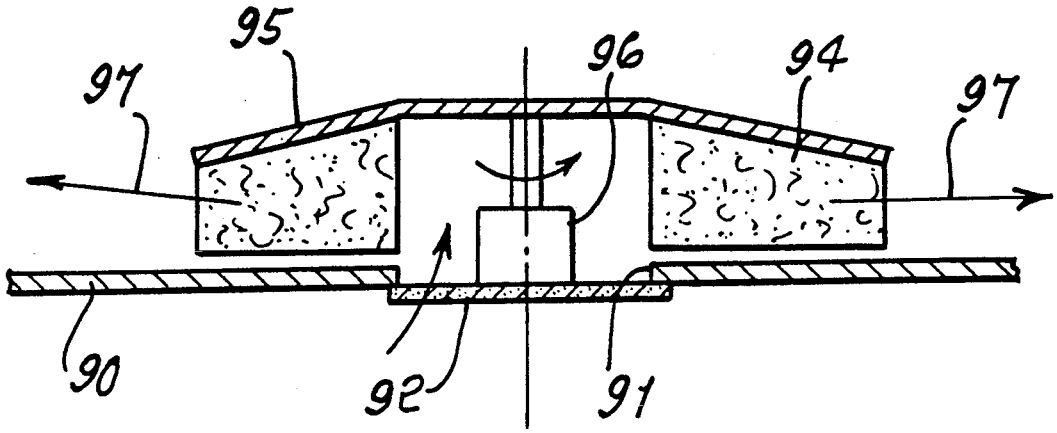

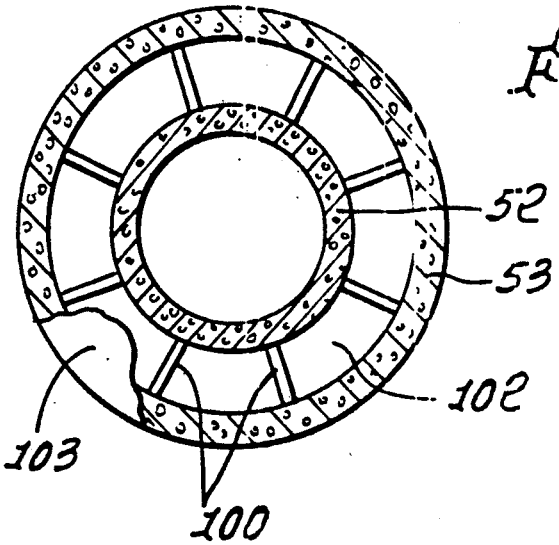
FIG. 8.
FIG. 10.
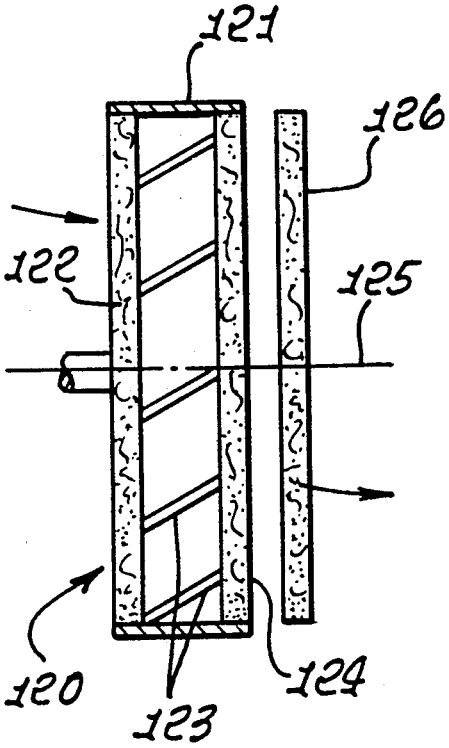
FIG. 9.
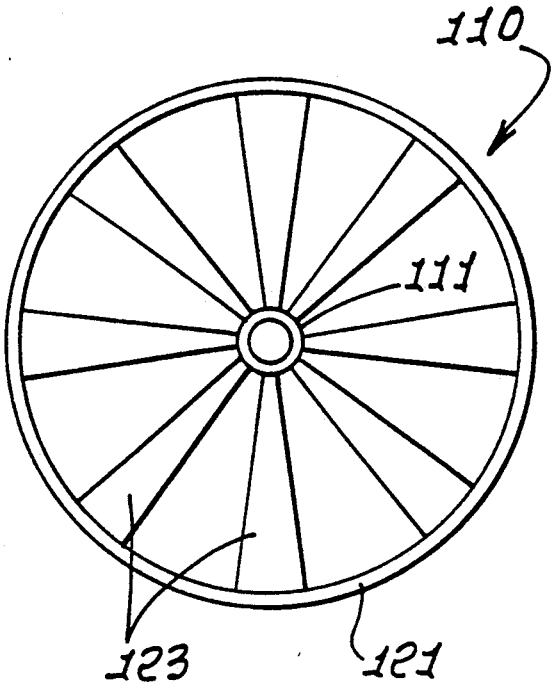

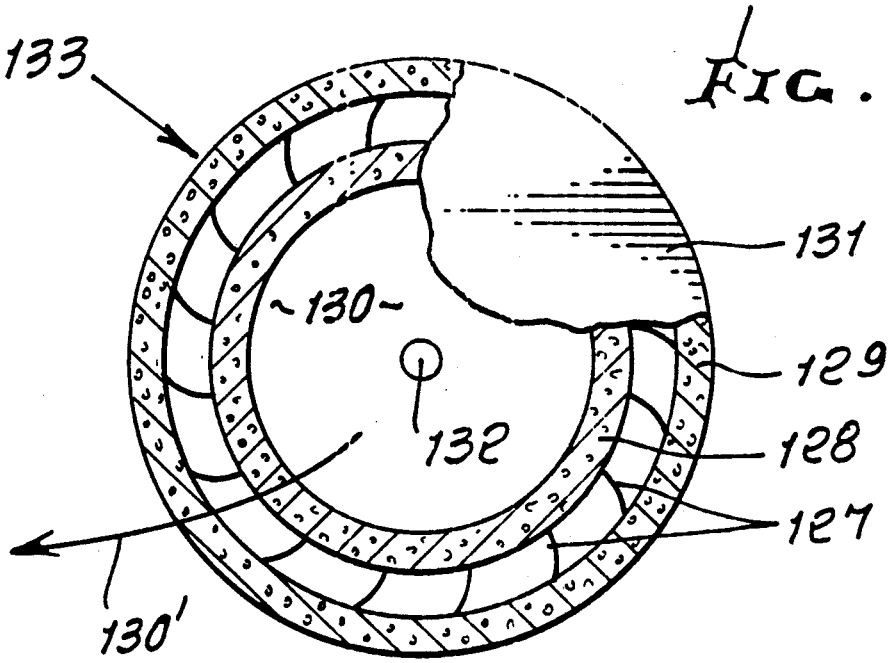
FIG. 11.
FIG. 12.
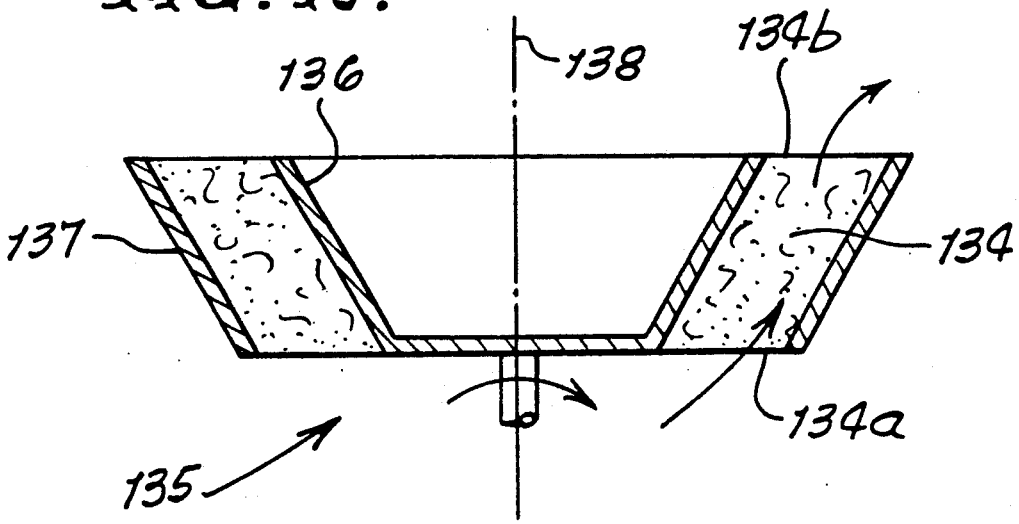

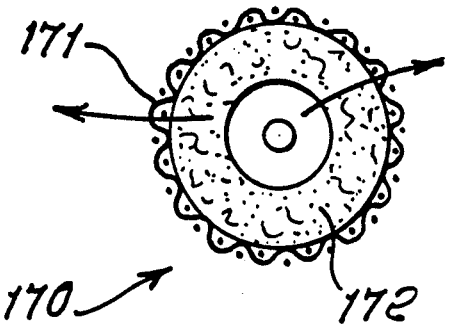
FIG. 16.
FIG. 17.
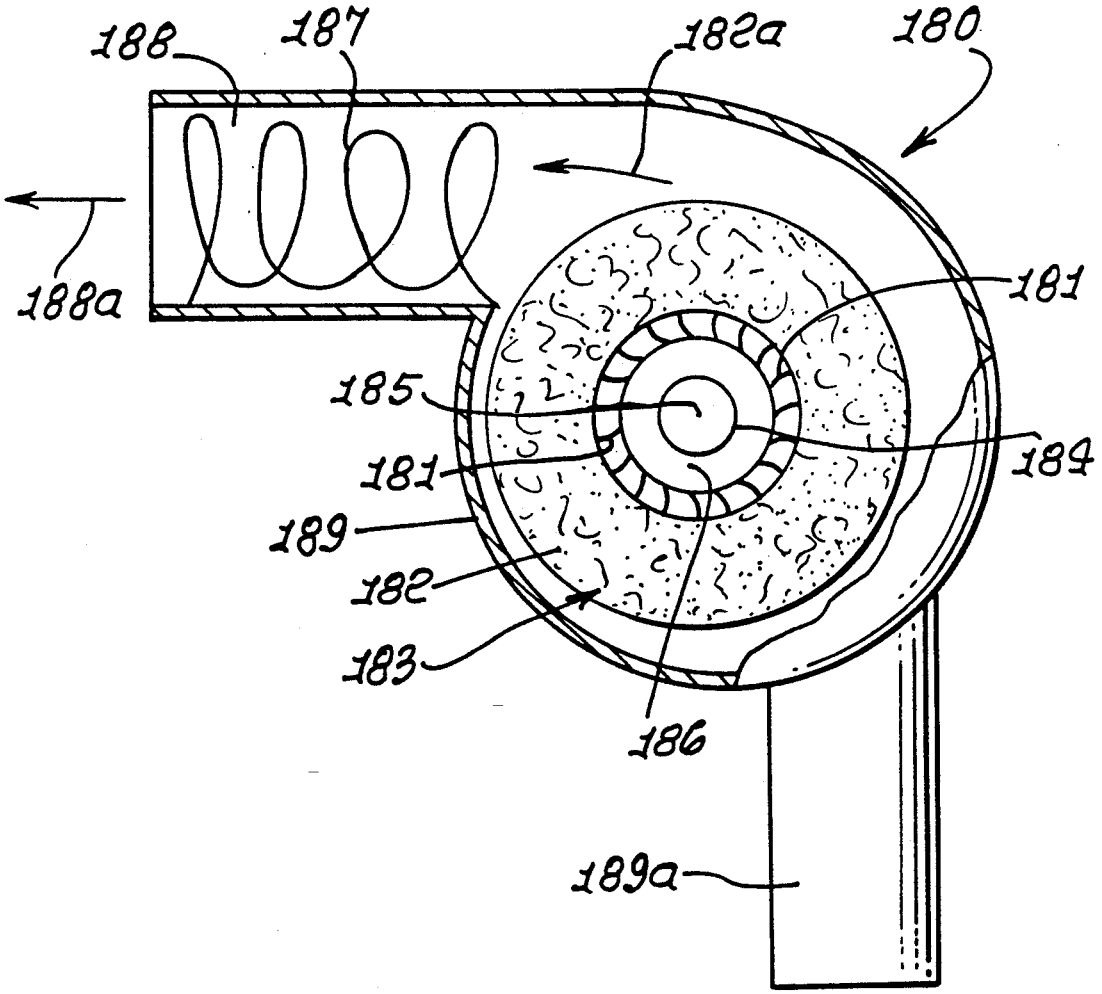

POROUS ROTOR

BACKGROUND OF THE INVENTION

This invention relates generally to improvements in rotors comprised of porous material to quietly pass fluid, such as gas, as such rotors rotate; and more particularly to such rotors operating as blowers or turbines by virtue of connection to driving or driven rotary structures.

U.S. Pat. No. 4,795,314 describes a quiet hair drier device wherein air is caused to pass through an annulus of porous material, such as foam, acting as a pump as the foam rotates. There is need to increase the air moving efficiency of such devices; and there is need to provide a class of efficiently operating devices wherein gas is caused to pass through rotating foam, or cellular structure, in a quiet manner, as in blowers or turbines.

SUMMARY OF THE INVENTION

It is a major object of the invention to provide an efficient rotary device wherein gas passes through rotating foam or porous material, the device being much more quiet in its operation than typical centrifugal and axial machines used for moderate air pressure production.

It is a further object is to provide a pump or blower of the type referred to. Thus, where the pump axle is forced to rotate, the rotor revolves and the fluid inside the porous matrix of the rotor also revolves. The fluid rotates at a somewhat slower rate than the matrix because the viscous drag force, which develops to move the fluid, only occurs when there is relative movement of the matrix through the fluid. A pressure gradient is developed outwardly from the axis of rotation, due to centrifugal force which causes the fluid to flow outwardly and follow an exit flow path.

Yet another object is to provide a turbine of the type referred to, the rotor operating in reverse to remove energy from the fluid stream and convert the angular momentum of the stream relative to the axle into torque on the axle. The fluid flows from a high-speed stream around the outside through the rotor, while slowing down, and then flows out the center. As it flows through the rotor, its circumferential velocity component relative to the rotor imparts the torque to the rotor via the viscous drag of the fluid on the matrix.

Noise minimization results from fluid entrance and exit conditions relative to the rotor which lack the shock and turbulence of typical blade-type devices, since the viscous forces self align with the local fluid flow directions in the porous matrix, which also damps the internal flow to minimize turbulence for quiet operation. In the porous annulus-type rotor, an important advantage is that the pressure is transferred between the fluid and the rotor through viscous coupling over the whole volume, and the effect of alternating high and low pressure from a small number of blades is not produced.

Among the advantages of the present invention over previous art are that it has much greater efficiency and pressure production capability, with reduced power consumption and noise generation, for a given task. The two most important parameters for efficient operation of the porous annulus rotor device are found to be (1) the ratio $\alpha$ of the inside diameter to the outside diameter, and (2) the ratio $\beta$ of two quantities, one representing the pressure due to drag, and the other centrifugal pressure from rotation (i.e., absolute viscosity of the fluid over the permeability of the porous matrix) over (fluid density times the rotational rate of rotor rotation). These parameters were found to have optimum ranges of value for efficient operation. The first ratio $\alpha$ should be less than 0.65 and practicality limits it to greater than about 0.3; while the second ratio $\beta$ is simultaneously required to be between 0.7 and 5, optimally between 1 and 3, except in the special case when some improvement can be found from adding a thin layer on the inside surface of the porous matrix and exhibiting a second ratio $\beta$ up to 15, in conjunction with the balance of the matrix having a ratio around 1.5.

Accordingly, the invention is embodied in apparatus comprising a) a fluid passing rotor comprising open porous structure extending along an annular path, the rotor forming passage means to pass fluid through the rotor porous structure as the rotor rotates, b) the path having an inner circumference with diameter ID and an outer circumference with diameter OD, and wherein $$\alpha = \frac{ID}{OD} < .65$$

(The ID/OD ratio can be replaced by the ratio of the inner radius to the outer radius of the flow path.)

As will be seen, the foam typically extends annularly continuously; and the rotary path has width $w_1$ at the inner circumference, and reduced width $w_2$ at the outer circumference, where $w_1 > w_2$. That path furthermore may have substantially continuously decreasing width between the inner and outer circumferences.

A further object is to provide a device having a ratio "$\beta$", as defined above, where $\beta$ is between 0.5 and 5.

Yet another object is to provide the rotor with wall means at opposite sides of the foam and extending directionally between the inner circumference and the outer circumference. Such wall means typically defines a channel therebetween occupied by the foam, the channel having taper directionally between the inner and outer circumferences.

Other objects include the provision of various porous rotor, and rotor section configurations, to be described, with and without rotor blades in combination with the porous material, and the provision of various type rotors, such as squirrel cage rotors, centrifugal and axial bladed rotors, honeycomb rotors, and multiple stage rotors.

These and other objects and advantages of the invention, as well as the details of an illustrative embodiment, will be more fully understood from the following specification and drawings, in which:

DRAWING DESCRIPTION

$$\frac{ID}{OD};$$

Figure 5:
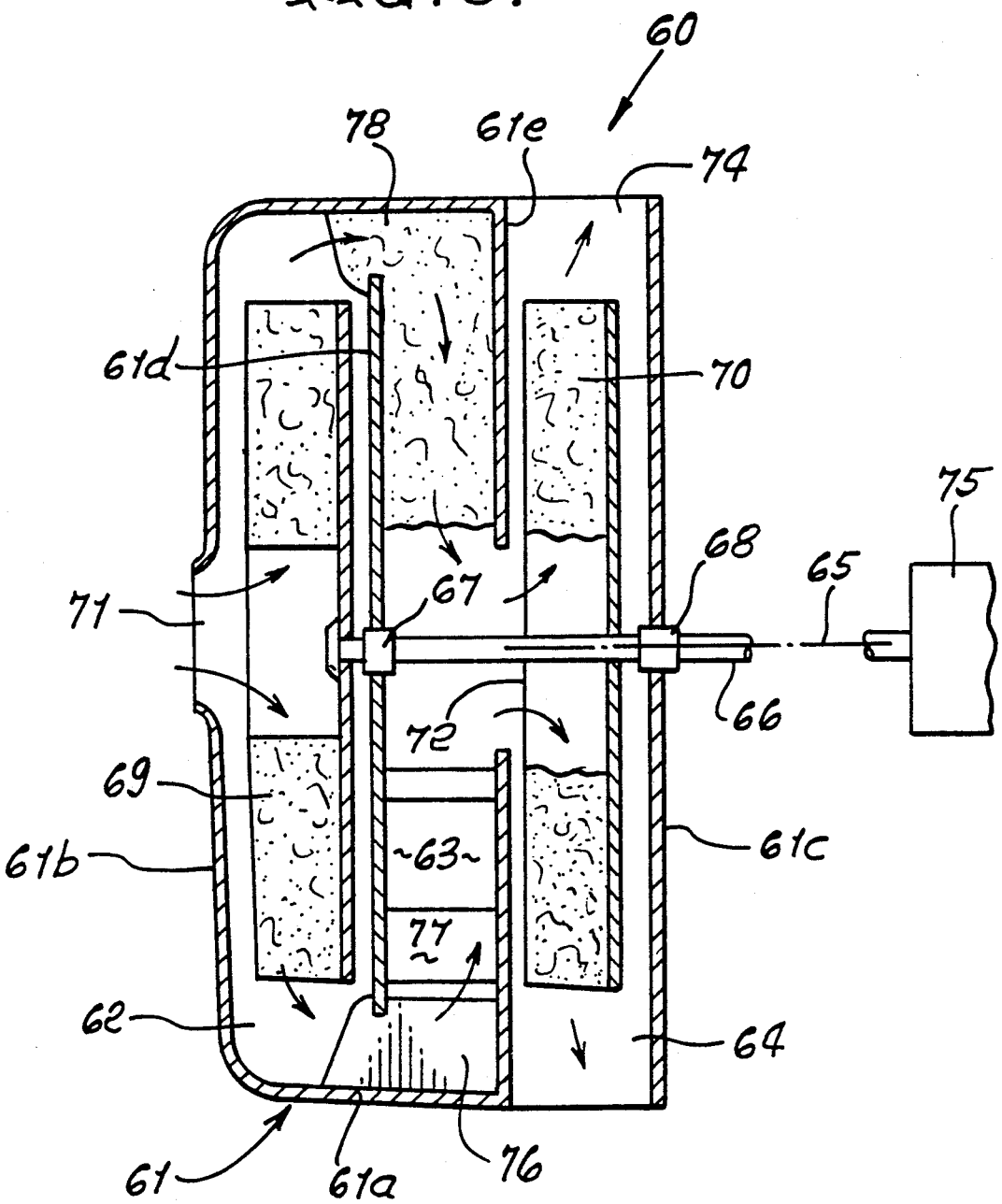
Figure 13:
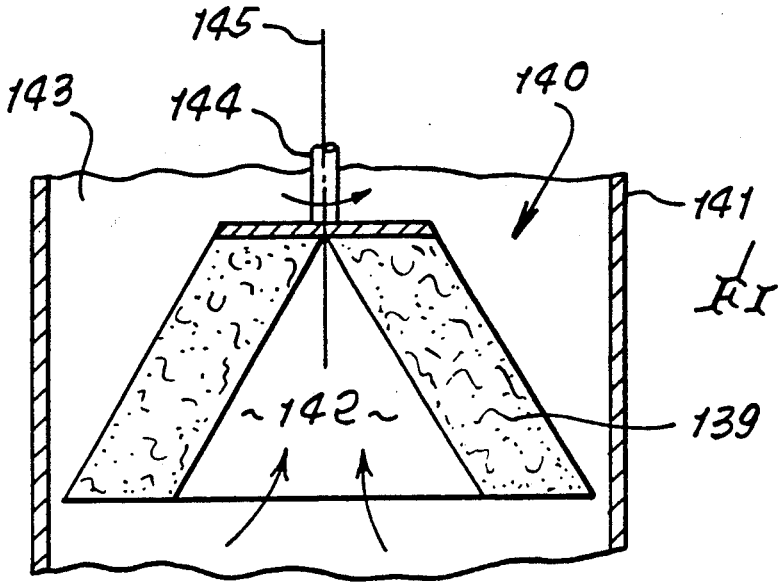
Figure 14:
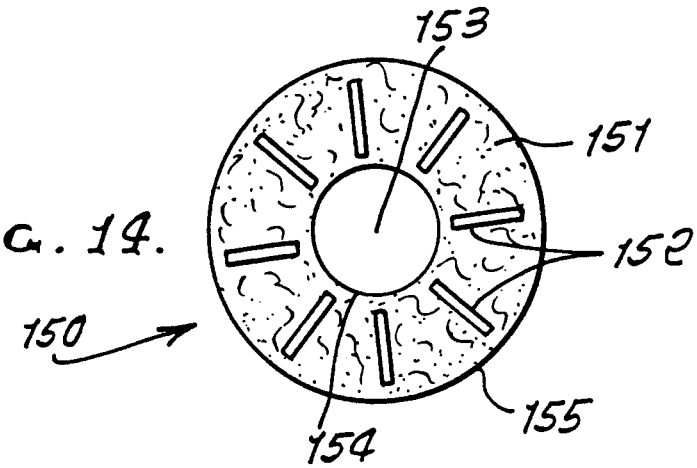
Figure 15:
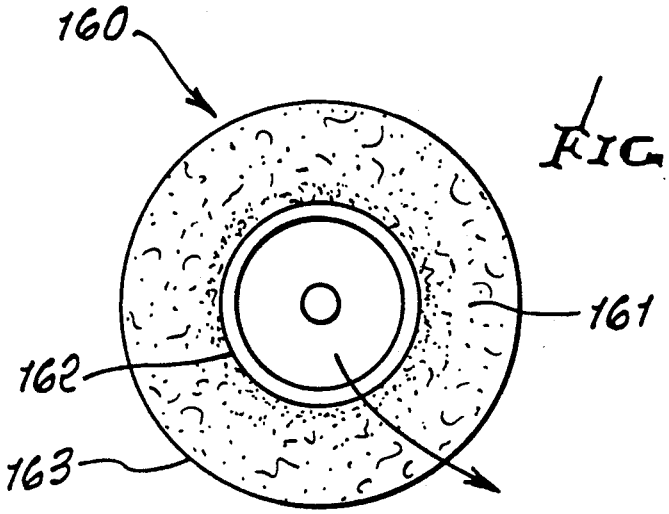
Figure 18:
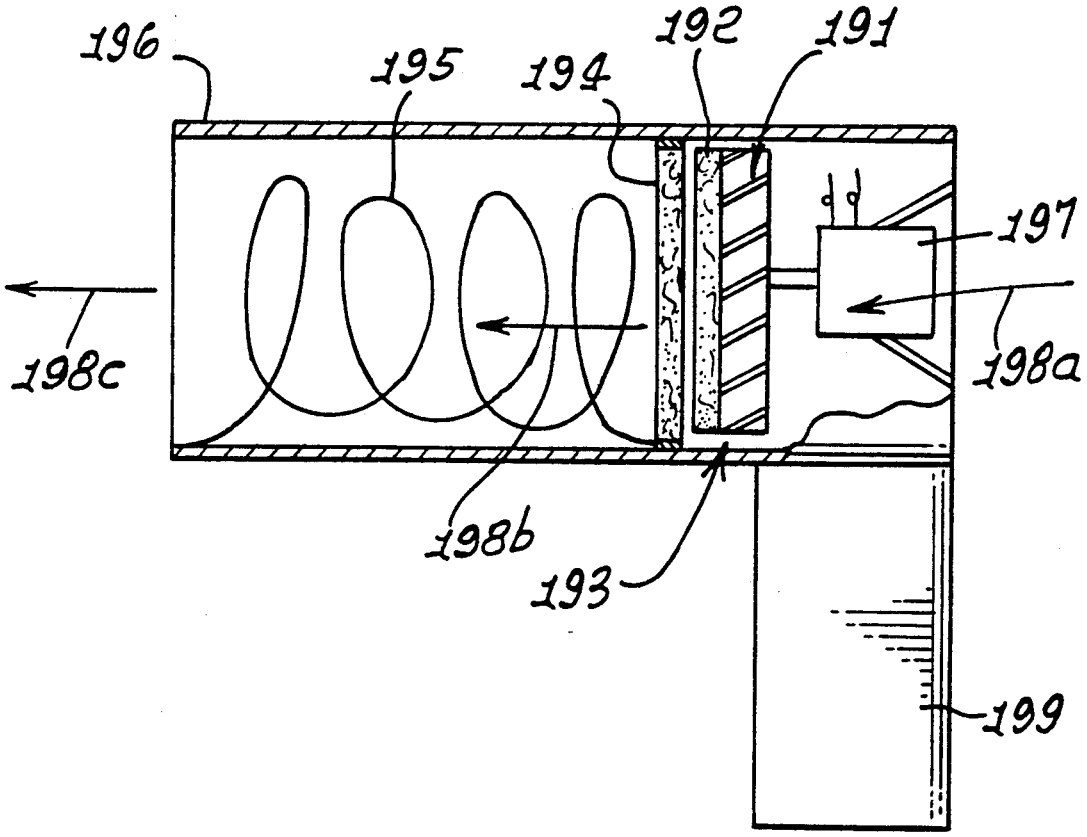
Figure 19:
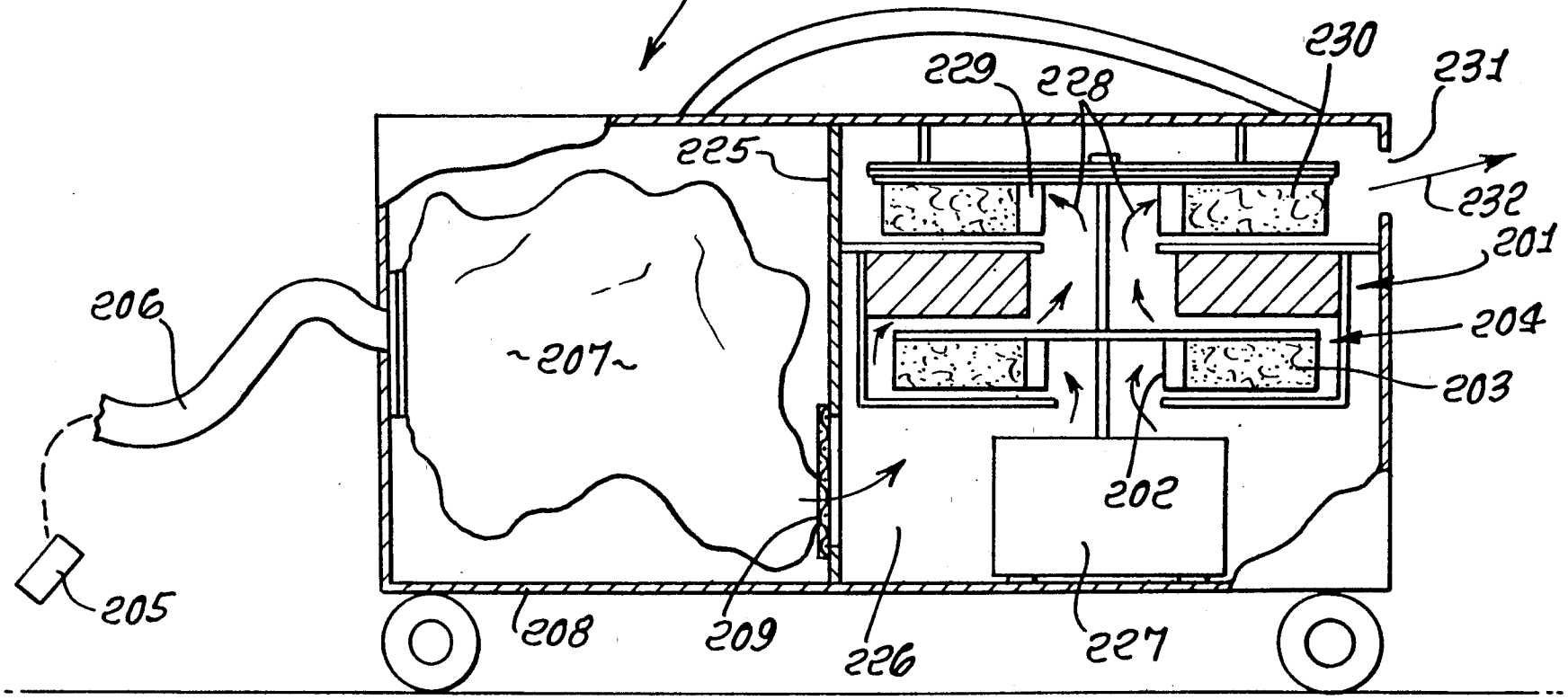
Figure 20:
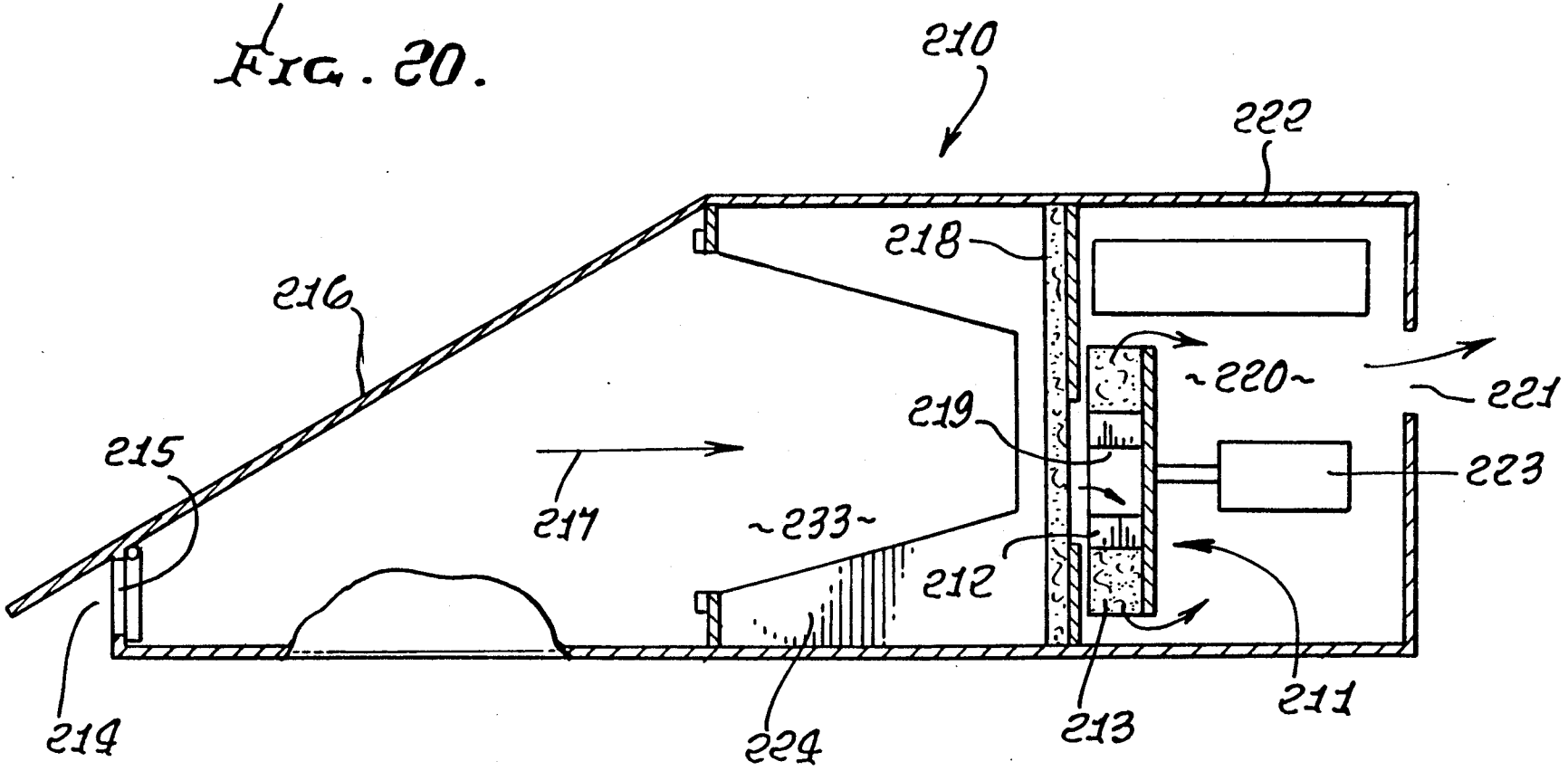

FIG. 4 is a section taken through a modified rotor;

FIG. 4a is an enlarged section taken on lines 4a—4a of FIG. 4;

FIG. 4b is a section taken on lines 4b—4b of FIG. 4;

FIG. 5 is a section taken through a two stage, porous, matrix rotor structure;

FIG. 6 is a section taken through a modified porous rotor structure that is axially tapered;

FIG. 7 is a section taken through a modified rotor structure associated with a fixed wall;

FIG. 8 is a frontal section taken through a fan rotor incorporating porous structure and fan blades;

FIG. 9 is a frontal view of an axial rotor;

FIG. 10 is a side elevational view of a modified axial rotor;

FIG. 11 is a frontal view of a squirrel cage rotor incorporating the invention;

FIGS. 12 and 13 are section taken through tapered porous rotors;

FIG. 14 is a frontal view of a porous rotor with contained blades;

FIG. 15 is a frontal view of a rotor having varying porosity;

FIG. 16 is a frontal view of a porous rotor having screen mesh;

FIG. 17 is a sectional view of a radial-type hair dryer utilizing a porous rotor;

FIG. 18 is a sectional view of an axial-type hair dryer utilizing a porous rotor;

FIG. 19 is a sectional view of a two-stage type vacuum cleaner utilizing a porous rotor; and FIG. 20 is a sectional view of a "dust buster"-type vacuum cleaner utilizing a porous rotor.

DETAILED DESCRIPTION

Figure 1:
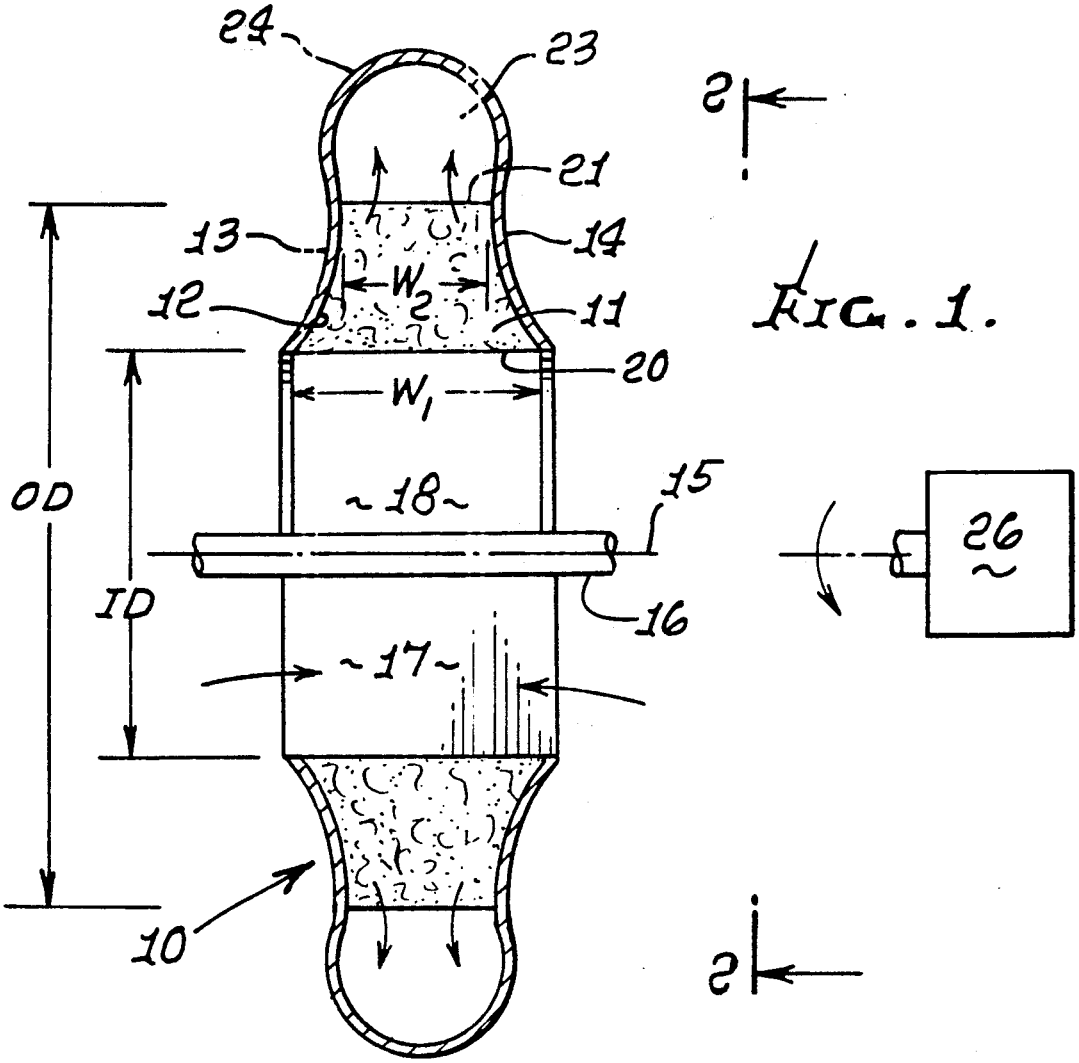
FIG. 1 is an enlarged section through a rotor, operating as a pump, and taken on lines 1—1 of FIG. 2.
Figure 2:
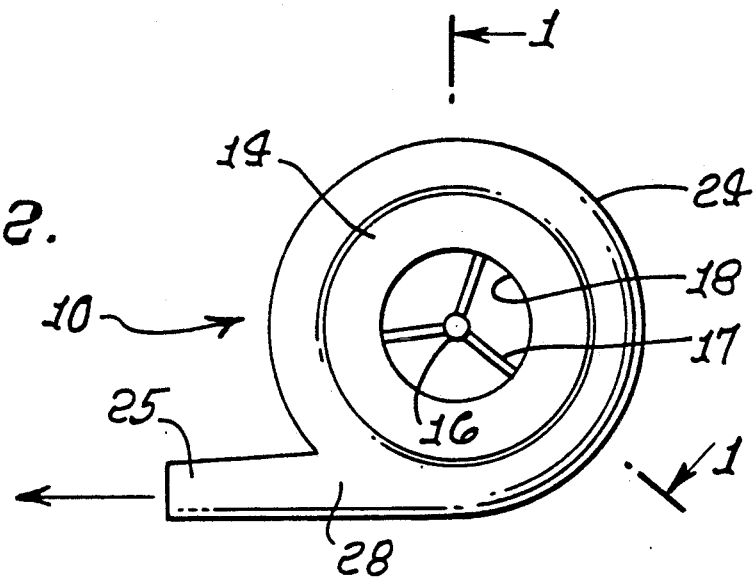
FIG. 2 is a side elevation taken on lines 2—2 of FIG. 1.

Referring to FIGS. 1 and 2, rotor 10 comprises open cell foam 11 (as for example, synthetic resin) extending along an annular path, and may be completely annular. The rotor also forms passage means 12, as between opposed walls 13 and 14, to pass fluid such as air, for example, through the open cell foam as the rotor rotates about axis 15. The rotor may be supported, as on an axle 16, as for example by ribs 17 extending from the axle to the walls 13 and 14, air entering the annular space 18 between the ribs. Space 18 lies radially inwardly of the foam 11.

The annular path described by the foam as it rotates has an outer diameter OD, and an inner diameter ID, as indicated; and for maximum efficiency, the ratio of ID to OD is as follows:

$$\alpha = \frac{ID}{OD} < .65 \quad (1)$$

Practicality limits the lower limit of that ratio as follows:

$$.3 < \frac{ID}{OD} < .65 \quad (2)$$

For maximum efficiency, a second ratio is also found to be important, i.e., the ratio $\beta$ of a quantity representing the pressure due to drag to a second quantity representing pressure from rotation, which is found to be (absolute viscosity over permeability of the foam matrix) over (the fluid density times rotational rate of the rotor). This second ratio B is required to be between 0.7 and 5, and optimally between 1 and 3, except in the special case where some improvement can be found by adding a local thin layer of relatively impermeable material on the inside surface of the matrix 11, along inner circumference 20 driving the ratio $\beta$ up to about 15, in conjunction with the balance of the rotor (not in registration with the layer) having $\beta$ of about 1.5.

It will also be seen that the rotary path of the porous matrix 11 (such as open cell foam) has a width $w_1$ at its inner circumference 20, and between walls 13 and 14; that the rotary path of the matrix has a width $w_2$ at its outer circumference 21 and between walls 13 and 14, and also that $$w_1 > w_2 \quad (3)$$

For example, $w_1$ can be 1.2 to 2 times $w_2$; and the annular path has substantially continuously decreasing widths between the inner and outer circumferences 20 and 21, providing a double-sided hyperbolic rotor. See the continuous taper of walls 13 and 14 in a radially outward direction, i.e., the fluid flow channel tapers from zone 18 to annular zone 23 about the foam matrix, zone 23 being formed by a volute 24 as in the case of a pump. The fluid may for example consist of air or other gas.

Pumped air or fluid, after passing through the matrix, collects in zone 23 and may be caused to discharge at 25. See FIG. 2. A power source to rotate axle 16 is seen at 26.

In the case of a turbine, pressurized air or fluid is supplied tangentially to annular zone 23, as via the tubular connection 28 in FIG. 2; and such pressurized air passes through the foam and exhausts from inner zone 18, acting to rotate the foam annulus and the walls 13 and 14 and axle 16. Walls 13 and 14 are typically attached to opposite sides of the foam matrix.

Figure 3:
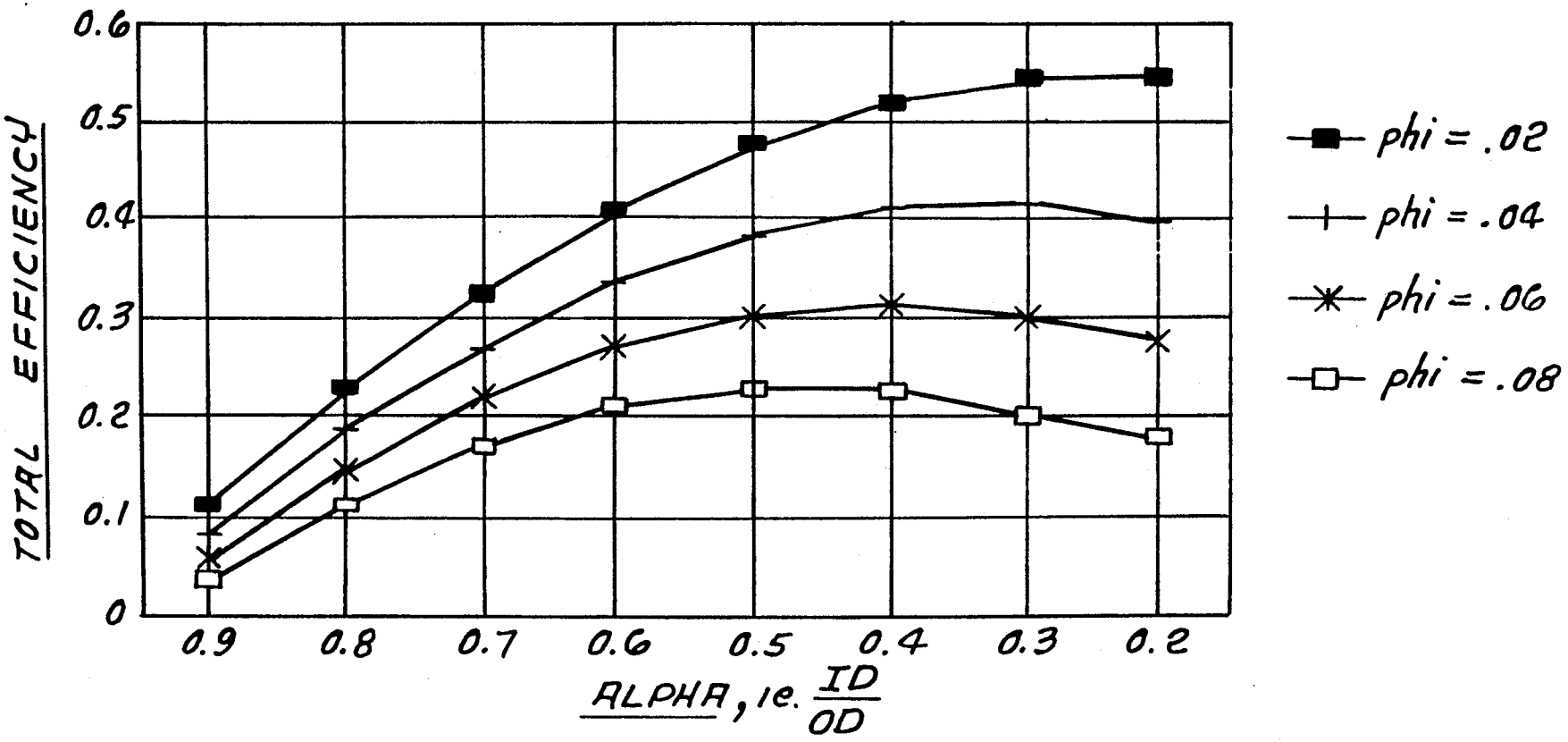
FIG. 3 is a graph showing rotor total efficiency vs.

FIG. 3 shows rotor efficiency vs. ID/OD values, optimum vales of which are between 0.65 and 0.3.

The invention provides an efficient rotor composed of porous material and a support structure which can be attached to a means to allow rotational movement. It can be used for adding energy to the fluid as a pump or blower, or it can be used as a turbine to extract energy from a pressurized fluid stream. A relatively efficient fluid rotor is provided for moderate pressure applications which is much quieter than the typical centrifugal machines used in the same pressure range.

In its most elemental form, the rotor is composed of one annulus of porous material attached to the side of a disc, concentrically located relative to a central axle.

Use of the rotor as a pump or blower is of importance. When the axle is forced to rotate, the rotor revolves and the fluid inside the porous matrix of the rotor also revolves. The fluid rotates at a somewhat slower rate than the matrix because the viscous drag force which develops to move the fluid only occurs when there is relative movement of the matrix through the fluid. The fluid rotation causes it to flow outwardly also and develop a pressure gradient outwardly from the axis of rotation due to centrifugal force.

As a turbine, the rotor works in reverse to take energy out of the stream, and convert the angular momentum of the stream relative to the axle into torque on the axle. The fluid flows from a high speed stream around the outside, through the rotor while slowing down and then flows out the center. As it flows through the rotor, its circumferential velocity component relative to the rotor imparts the torque to the rotor via the viscous drag of the fluid on the matrix.

Noise minimization results from several advantages. The fluid entrance and exit conditions relative to the rotor lack the shock and turbulence of typical blade-type devices, since the viscous forces inherently align with the local flow direction in all conditions. The matrix also damps the internal flow to minimize turbulence for quiet operation. Of advantage is the fact that the pressure is transferred between the fluid and the rotor through viscous coupling over the whole volume, and the effect is alternating high and low pressure from a small number of blades is not produced.

Among the advantages of the present invention over previous art are the fact that the rotor exhibits much greater efficiency and pressure capability, and thereby reduced power consumption and noise generation, for a given task. The two most important parameters for efficient operation were found to be 1) the ratio $\alpha$ of the inside diameter to the outside diameter; and 2) the ratio $\beta$ of two quantities, one representing the pressure due to drag, and the other pressure from rotation, i.e., (absolute viscosity over permeability of matrix) over (fluid density times rotational rate of rotor). These parameters were discovered to have optimum ranges of value for efficient operation. The first ratio needs to be less than 0.65 and practicality limits it to greater than about 0.3; while the second ratio is simultaneously required to be between 0.7 and 5, optimally between 1 and 3, except in special cases when some improvement can be found from adding a thin layer on the inside surface with the second ratio $\beta$ up to 15 in conjunction with the balance of the matrix having a ratio around 1.5.

The previous patents to Abott U.S. Pat. No. 3,123,286 and McDonald U.S. Pat. No. 3,128,940 show, however, very large inside diameter to outside diameter ratios of 0.8 and 0.7, respectively, in their rotor matrix structures. Contrary to appearances, prior designs would be very inefficient when compared to even simple devices with ratio $\alpha$ smaller than about 0.6. Thus, the efficient porous rotor described herein with ratio $\alpha$ less than 0.5 can have nearly twice the efficiency of one with a ratio of 0.7.

The ratio $\beta$ is independent of the diameter of the rotor, and so applies to all size devices similarly.

The performance of a porous rotor used as a pump or blower can be described by a set of equations. The most illustrative factor is the total efficiency, relating the total output of the device to the work input. As a function of the non-dimensional parameters introduced above and others defined below, the equations that follow yield numbers which apply to a rectangular cross section rotor:

$$\text{total efficiency} = \frac{-\phi\left[q_{st} + \dfrac{(1 + v_\sigma(1)) + \phi^2\left(\dfrac{\alpha^2 - 1}{\alpha^2}\right)}{2}\right]}{\beta\int_\alpha^1 r^2 v_\sigma dr}$$

where $$q_{st} = \beta\phi\ln(\alpha) + \frac{1-\alpha^2}{2}\left[\frac{\phi^2}{\alpha^2} + 1\right] + \int_\alpha^1\left(\frac{v_\sigma^2}{r} + 2\,v_\sigma\right)dr$$

-continued and where $v_\sigma(r)$ = non-dimensional circumferential velocity referenced to rotor outside velocity with $r = \dfrac{R}{R_{outside}}$ and ranges from $\alpha$ to 1 and $v_\sigma$ can be found from the equation set $$\frac{dv_\sigma}{dr} = -\left(\frac{\beta}{\phi}r + \frac{1}{r}\right)v_\sigma - 2, \quad v_\sigma(\alpha) = -\alpha$$

with $$\beta = \frac{\mu/\kappa}{\rho\omega}, \quad \phi = \frac{v_{routside}}{r_{outside}\omega}, \quad \alpha = \frac{r_{inside}}{r_{outside}}$$

and $\mu$ = viscosity of fluid
$\kappa$ = permeability of matrix
$\omega$ = rotational velocity
$\rho$ = density of fluid The cross sectional shape of the rotor is a third fundamental variable embodied in essence by a third ratio, the ratio of the width of the matrix exposed to the fluid on the interior face, to the width exposed on the outer face. It is apparent this is only important when ratio $\alpha$ is in its efficient range. When ratio $\alpha$ is above 0.7, a variation in width is unimportant, as the relative thickness is small. Having the sides taper to increase the axial width of the rotor toward the axle improves the performance. The shape shown in FIG. 1 has hyperbolic, curved surfaces provided by walls 13 and 14, which is ideal, to minimize the exterior structure, and it has an equal flow area cross section at every radius. Shapes may also be used in the directing of intake and exhaust flow directions.

Varying the porosity with the radius is another way of manipulating its operating parameters and efficiency. This has an effect similar to tapering the cross section, as it controls the rate of change of the rotational velocity of the fluid with radius. Achieving variation in density may be accomplished with a porosity gradient material or with composite construction techniques. An example of this composite construction would be concentric annuli of different porosity materials. In a flat sided blower rotor with a ratio $\alpha$ of 0.5, a 3% layer of material with a ratio $\beta$ of 11 on the inside, with the balance of the matrix having a ratio of 1.8, has a pressure capability and efficiency 3% and 4% better, respectively, than the optimum monolithic material, which would have a ratio $\beta$ of 2. A more dramatic relative improvement is possible when starting with a thin rotor, for example, ratio $\alpha$=0.75, then changing per the prior example brings a 10% improvement in the performance parameters. In turbine applications, the less porous material would be on the outermost surface instead, where the fluid enters the rotor.

A fundamental design constraint of any rotor is not to have the axial width much greater than the inlet diameter, to minimize inlet pressure drop. This improvement then applies to rotors whose ratio $\alpha$ is below 0.7 or so.

These surfaces 13 and 14 are ideally suited to be structural elements to hold the rotor matrix in position.

Anisotropic porosity in the matrix is an area for efficiency improvements. A tubular matrix, such as a honeycomb material, (i.e., cellular) with its openings directed generally radially outward from the axis of rotation, in combination with inner and/or outer annuli made from a finer porosity material, is an example of such a structure and is shown in FIGS. 4, 4*a* and 4*b*.

As shown, the rotor 50 has an axis of rotation 51, an inner annular porous section 52, and an outer and concentric annular porous section 53. Interior 54 is open, and serves to pass fluid (as for example air) to the inner section 52, from which the fluid passes through honeycomb material 55 between section 52 and 53, to and through the outer section 53. Wall structure 57 supports 52, 53, and 55, at one axial side thereof, and may be used to rotate the latter about axis 51. An additional view of the cellular center material is shown in FIG. 4*a*.

The porous material 52 in this case can be used to bring fluid in from the intake and bring it to rotor rotational speeds before it enters the honeycomb channels. The same is true of the exit, where a smooth angular velocity transition at all operating points is accomplished by material 53. Whistling and turbulence, which occur when the honeycomb structure is used alone, is eliminated.

FIG. 5 shows a two-stage, radially symmetric blower 60. Casing 61 includes an outer annular wall 61*a*, opposite end walls 61*b* and 61*c*, and two intermediate walls 61*d* and 61*e* together defining chambers 62, 63, and 64, which are axially spaced apart. See axis of rotation 65, defined by a shaft 66, supported at bearings 67 and 68. The shaft supports axially spaced porous discs 69 and 70, in the chambers 62 and 64, respectively.

Fluid enters chamber 62 at opening 71, is pumped radially through porous annulus 69, is turned into chamber 63, and flows radially inwardly therein to eye 72, enters chamber 64 and is pumped radially outwardly by rotating porous annulus 70. Fluid then leaves the casing at outlet 74. Motor 75 rotates shaft 66. Fixed flow guide vanes may be provided at 76 (between chambers 62 and 63) and at 77, in chamber 63; or fixed porous material 78 may be provided in place of vanes 76 and 77. The purpose of either porous matrix 78, or vanes 76 and 77, or both, is to slowdown the tangential velocity of the fluid from the matrix 69 to allow it to flow back to the center.

FIG. 6 shows a modified rotor 80 having an axis of rotation 81, and porous matrix material 82 extending generally frusto-conically, from an axial inlet 83, to an annular outlet 84, axially spaced from 83. Conical inner and outer walls 89 and 89*a* define the conical flow passage filled with material 82. The outlet flow has an axial flow component 85. Inlet flow is shown at 86. A motor to rotate the rotor via shaft 87 appears at 88.

FIG. 7 shows an application of the invention to serve as a blower at a room ceiling 90. Hole 91 in the latter passes air through a filter 92 at 91, from which air is blown outwardly through matrix porous structure 94. Ceiling 90 serves as one wall for matrix 94, and the opposite rotating wall is seen at 95. Motor 96 is centrally supported by the ceiling, and rotates wall 95 and matrix 94. Air flows radially outwardly via the matrix at 97.

FIG. 8 is like FIG. 4*b* except that honeycomb material is omitted, and rotor blades 100 are located in the space 102 between porous sections 52 and 53. Blades 100 extend generally radially in the space 102, and assist in pumping fluid from 52 to 53. Side walls, as at 103, can cover axially opposite sides of 52, 53 and 100. Section 52 may be omitted, since the major source of noise generation occurs at the fluid exit of the rotor and only a very small amount of noise comes from the inlet.

FIG. 9 shows a frontal view of an axial rotor 110 without foam covering discs. Radial blades 123 connect drive hub 111 to cylindrical shell 121.

In FIG. 10, a side view of an axial fan rotor 120 is shown, having a cylindrical shell 121 containing in axial sequence a porous matrix disc 122, angled rotor blades 123, and a porous matrix disc 124. As the rotor rotates about axis 125, fluid, such as air, is drawn axially through disc 122; it passes between the rotating blades, and it then is discharged axially through disc 124. In actual construction, inlet porous disc 122 would usually not be included, since the major source of noise occurs at the outlet of the rotor. A non-rotating, porous disc 126 may be used to stop the swirl motion of the outlet stream.

In FIG. 11, the rotor 133 has an axis 132, support disc 131, rotor blades 127 spaced about that axis to form a "squirrel cage"-type rotor, and outer porous matrix annulus 129 at the outer sides of the blades. It can also have an inner porous annulus 128 around the inside surface of blades. Fluid is drawn from space 130 through annulus 128, as the rotor spins around axis 132, then between the rotating blades, and then passes through annulus 129. See arrow 130'. The rotor uses disc 131 for support and torque transmission.

In FIG. 12, the porous material 134 in rotor 135 is in the form of a truncated cone, with its inner and outer sides covered by non-porous conical shells 136 and 137. As the rotor is rotated about its axis 138, fluid flows in the smaller diameter end 134*a*, passes through 134 and emerges at the larger diameter end 134*b*.

In FIG. 13, the porous material 139 in rotor 140 is again in the form of a truncated cone, rotating within a cylindrical outer shell 141. Fluid, such as air, is drawn into the open space 142 surrounded by the conical material 139; it then passes through the latter and emerges at the downstream side 143 of the material 139, in response to cone rotation on shaft 144, having axis 145.

In FIG. 14, the rotor 150 has an annulus 151 of porous material (such as foam) through which fluid, such as air, is caused to flow, as in FIGS. 1–3. Rotor blades 152 of non-porous material are embedded in the foam, and spaced about axis 153 of rotation, to assist in causing fluid flow through the annulus 151, as described, i.e., between ID at 154, and OD at 155. The advantage is that a matrix with greater permeability and less drag could be used for potentially greater efficiency.

In FIG. 15, the rotor 160 is again like that of FIG. 1, but the annulus of porous material 161 has variable porosity, from its inlet side to its outlet side. For example, porosity may progressively increase from ID at 162, to OD at 163, fluid flowing from 162 to 163 as the rotor rotates.

In FIG. 16, the rotor 170 is like that described in FIGS. 1–3. A screen mesh 171 extends around the OD of the porous structure 172, to contain it as it rotates at high speed.

Other embedded structures may be used for structural purposes, for directing fluid flow or as another means of producing fluid movement within the rotor. An example of this would be small blade-like spines protruding outwardly in the axial direction from the rotor disc to limit deformation of the porous material at high rotational speeds while aiding fluid flow. If kept buried in the matrix, noise from small blades would be quieted before its exit. Embedded blades (i.e., embedded in the porous matrix) can be used to direct flow through the porous material as well as direct the intake and exhaust fluid flows. The use of porous material in conjunction with axial, centrifugal and squirrel cage-type air movers will reduce noise generation by eliminating blade tip noise as well as dampen the pulsing noise typically generated by these types of air movers.

Higher pressure ratio outputs for blowers in smaller packages may be obtained with rotors placed in series (staged) configuration. Then, pressurized air developed by the first rotor is fed to the second rotor for further pressurization, to achieve the pressures needed in some blower and vacuum applications. See FIG. 5.

Rotors, as blowers or pumps, can be used for exhausting fluids, with the emphasis upon sucking fluid out of a volume. In this case, it can exhaust from the fan in all directions, with no shroud in many cases. The counterpart is a device with a requirement to develop a high energy stream of pressurized fluid. It operates to collect and organize the flow from the rotor, typically by the use of a spiral volute to collect the flow with minimum speed reduction and direct it to the objective. See FIG. 7.

Another feature of viscous drag fluid movers is that they cannot cause cavitation when handling liquids. The lack of cavitation potential results from the viscous forces which accelerate the liquid occurring throughout the volume of the rotor. No section is lifted by a blade leaving an extreme low pressure zone underneath it, where the local pressure could reach the vapor pressure of the liquid.

The rotor has applications to many devices. Some of these devices are listed below:

exhaust fans (bathroom, conference room, etc.)
vacuum cleaners
leaf blowers
"Dust Buster"-type devices
Computer and electronic equipment fans
low cavitation pumps
quiet turbines
hair dryers.

The following are examples of the other applications of the porous rotor.

FIG. 17 shows a cross section through a radial hair dryer 180 with combination blades 181 and a porous material 182 type rotor 183. A motor 184 drives the blades and rotor about a common axis 185, the blades receiving air from side inlet 186 and displacing the air into the annular porous matrix 182. Air discharging at **182*a* from the rotating matrix passes through electrical resistance type heater coils 187, and through a duct 188 as a hot air stream 188*a*. A housing volute appears at 189 and a handle at 189*a***.

FIG. 18 shows a cross section of an axial-type hair dryer with combination blades 191 and porous material disc 192 type rotor 193. Stationary porous material disc 194 straightens the outlet flow from the rotor 193. Swirl is eliminated and the flow across heating coils 195 is made less turbulent and less noisy. Housing tube 196 contains 191, 192, 194, 195, and an electrical motor 197 that drives rotor 193, so that entering air flows at **198*a* over the motor, then through the blades 191, then through rotating porous disc element 192 of the rotor, then through the flow straightening porous material fixed disc 194, then at 198*b* through or past the hot electrical coils 195, and then discharges as a hot stream at 198*c*. A handle 199 is attached to tube 196**.

FIG. 19 shows in cross section a vacuum cleaner 200 with a two-stage rotor system 201 like the one shown in FIG. 5. This drawing shows inlet blades 202 in combination with porous material 203 to form the rotors 204 in this system. Air is sucked from an applicator head 205, via a duct 206, to a dust collection bag 207, in a housing 208. Suction air passes from the bag through a screen 209 in a divider wall 225, and into a compartment 226. Electrical motor 227 in 226 drives the two-stage rotor system, causing suction air to pass through annularly spaced blades 202 and radially through the associated annular porous matrix 203. Air then flows at 228 past annularly spaced blades 229 and radially through the associated annular porous matrix 230, to discharge from the housing at vent 231. See arrow 232.

FIG. 20 shows a cross sectional view of a "dust buster"-type vacuum cleaner 210. The rotor 211 is a combination blade 212 and porous material 213 type rotor. Air is sucked through an inlet 214 in a nozzle 215 of an expanding head 216, and then flows at 217 at reduced velocity through a porous material fixed filter disc 218 to enter the eye 219 of the annular rotor 211. Air then flows between the annularly spaced blades 212 and radially through the annular porous matrix 213 to discharge into compartment 220, and then to the exterior via vent 221 in casing 222. Electrical drive motor 233 is in 220. Dust collects in compartment 223, between panels 224 extending toward 218.

We claim:

1. A quiet fluid passing apparatus, comprising:

a) a fluid passing rotor comprising open porous structure extending along an annular path, the rotor forming passage means to pass fluid through the rotor open cellular structure as the rotor rotates, b) said path having an inner circumference with diameter ID and an outer circumference with diameter OD, and wherein $$\frac{ID}{OD} < .65$$

c) and wherein said path has substantially continuously decreasing width between said inner and outer circumferences.

2. The apparatus of claim 1 wherein said porous structure extends annularly continuously.

3. The apparatus of claim 1 wherein said rotor has an axis and said path has width $w_1$ at said inner circumference, and width $w_2$ at said outer circumference, where $w_1 > w_2$, said width measured parallel to said axis.

4. The apparatus of claim 3 wherein said porous structure extends annularly continuously along said path and has said widths $w_1$ and $w_2$.

5. The apparatus of claim 1 wherein said porous structure extends annularly continuously along said path, and has said continuously decreasing width between said inner and outer circumferences.

6. The apparatus of claim 1 wherein the rotor has an axis, and including means connected in driving relation with said rotor to rotate the rotor about said axis, for causing fluid to pass outwardly through said porous structure relative to said axis.

7. The apparatus of claim 1 wherein the rotor has an axis, and including means extending in driven relation with the rotor to be rotated by the rotor as fluid passes inwardly through said porous structure, relatively toward said axis.

8. The apparatus of claim 1 wherein the rotor has wall means at opposite sides of said porous structure and extending directionally between said inner circumference and said outer circumference.

9. The apparatus of claim 8 wherein said wall means defines a channel therebetween occupied by said porous structure, said channel tapering directionally between said inner and outer circumference, said porous structure comprising an open cell porous matrix.

10. A quiet fluid flowing apparatus, comprising:

a) a fluid passing rotor comprising open cell foam extending along an annular path having inner and outer circumferences, the rotor forming passage means to pass fluid through the rotor open cell foam as the rotor rotates, b) the rotor having wall means at opposite sides of said foam and extending directionally between said inner circumference and said outer circumference, c) said wall means defining a channel therebetween occupied by said foam, said channel tapering directionally between said inner and outer circumferences and toward said outer circumference.

11. The apparatus of claim 10 wherein said foam extends annularly continuously.

12. The apparatus of claim 10 wherein said path has width $w_1$ at said inner circumference, and width $w_2$ at said outer circumference, where $w_1 > w_2$.

13. The apparatus of claim 12 wherein said path has substantially continuously decreasing width, between said inner and outer circumference.

14. The apparatus of claim 10 including means connected in driving relation with said rotor to rotate the rotor about said axis, for causing fluid to pass outwardly through said foam relative to said axis.

15. The apparatus of claim 13, wherein the rotor has an axis, and including means connected in driving relation with said rotor to rotate the rotor about said axis, for causing fluid to pass outwardly through said foam relative to said axis.

16. The apparatus of claim 10 wherein tho rotor has an axis, and including means extending in driven relation with the rotor to be rotated by the rotor as fluid passes inwardly through said foam, relatively toward said axis.

17. The apparatus of claim 10 including an auxiliary wall extending at least partly about said rotor at the outer side of said foam, to restrict fluid flow in the foam inwardly of said auxiliary wall.

18. The apparatus of claim 10 wherein said foam has open cells for passing said fluid in the form of gas.

19. The apparatus of claim 18 wherein said gas consists of air.

20. The apparatus of claim 1 wherein said rotor is characterized by a ratio $\beta$ defined as: pressure due to drag divided by centrifugal pressure from rotation.

21. The combination of claim 1 wherein said porous structure includes an inner annular section, and an outer annular section, with an annular gap therebetween.

22. The combination of claim 21 including honeycomb material in said gap, and defining cellular openings passing fluid radially between said porous sections.

23. The combination of claim 1 wherein said porous structure has an outer annular section and an inner annular section comprised of honeycomb material.

24. The combination of claim 1 wherein said porous structure includes two sections spaced along the axis of rotation of said rotor, and there being casing structure and walls defining chambers receiving said sections and passages to pass inlet fluid first to one of said sections via na inlet to be pumped radially, and then to be channeled to the other of said sections via another inlet to be pumped radially, and to an outlet defined by said casing structure.

25. The combination of claim 1 wherein said porous structure extends generally frusto-conically.

26. The combination of claim 1 wherein said room ceiling defining an air opening, and said rotor above said ceiling and having its passage means in direct communication with said ceiling opening, and a motor to rotate said rotor.

27. The combination of claim 1 including a screen mesh extending about said porous structure.

28. A radial hair dryer-type structure comprising the apparatus of claim 1 wherein said rotor comprises the fluid driving means in said structure, said structure including an air heater.

29. The "dust buster"-type vacuum cleaner structure comprising the apparatus of claim 1 wherein said rotor comprises the fluid driving means in said structure, said structure including a dust receiver.

* * * * *